US009960477B2

(12) United States Patent
Bevelacqua et al.

(10) Patent No.: US 9,960,477 B2
(45) **Date of Patent: *May 1, 2018**

(54) ANTENNA ASSEMBLY UTILIZING SPACE BETWEEN A BATTERY AND A HOUSING

(71) Applicant: Google LLC, Mountain View, CA (US)

(72) Inventors: Peter Bevelacqua, Mountain View, CA (US); Timothy John Prachar, Mountain View, CA (US)

(73) Assignee: Google LLC, Mountain View, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/297,791

(22) Filed: Oct. 19, 2016

(65) Prior Publication Data

US 2017/0040666 A1 Feb. 9, 2017

Related U.S. Application Data

(63) Continuation of application No. 14/157,139, filed on Jan. 16, 2014, now Pat. No. 9,496,601.

(51) Int. Cl.

| | |
|---|---|
| ***H01Q 1/44*** | (2006.01) |
| ***H01Q 1/24*** | (2006.01) |
| ***H01Q 1/27*** | (2006.01) |

(52) U.S. Cl.
CPC ..... *H01Q 1/241* (2013.01); *H01Q 1/273* (2013.01); *H01Q 1/44* (2013.01)

(58) Field of Classification Search
CPC ..... H01Q 1/241; H01Q 1/273; H01Q 1/44
USPC ..... 343/702
See application file for complete search history.

(56) References Cited

U.S. PATENT DOCUMENTS

| | | | |
|---|---|---|---|
| 6,297,776 | B1 | 10/2001 | Pankinaho |
| 7,928,910 | B2 | 4/2011 | Suzuki et al. |
| 8,442,602 | B2 | 5/2013 | Wong et al. |
| 2006/0281500 | A1 | 12/2006 | Huang et al. |
| 2008/0018543 | A1 | 1/2008 | Baliarda et al. |
| 2011/0121079 | A1 | 5/2011 | Lawrence et al. |
| 2012/0230377 | A1 | 9/2012 | Jenwatanavet et al. |
| 2013/0257712 | A1 | 10/2013 | Imamura |

*Primary Examiner* — Andrea Lindgren Baltzell
(74) *Attorney, Agent, or Firm* — McDonnell Boehnen Hulbert & Berghoff LLP; Michael Anderson

(57) ABSTRACT

A device is provided that includes (a) an antenna that includes at least one conductor, (b) a housing that includes an inner-upper surface and an inner-lower surface separated by a first distance, (c) a battery disposed within the housing, where a base surface of the battery is proximate to the inner-lower surface of the housing, where a first portion of the battery has a height, which is substantially equal to the first distance, and where a second portion of the battery is of lesser height than the first portion of the battery such that space exists between the second portion of the battery and the inner-upper surface of the housing, and (d) where the one conductor is arranged over the second portion of the battery in the space, such that the one conductor and the battery do not contact one another, and where, as arranged, the antenna is capable of a far-field communication.

20 Claims, 11 Drawing Sheets

ANTENNA ASSEMBLY UTILIZING SPACE BETWEEN A BATTERY AND A HOUSING

CROSS-REFERENCE TO RELATED APPLICATION

This application is a continuation of co-owned U.S. patent application Ser. No. 14/157,139, filed on Jan. 16, 2014, which is incorporated herein by reference in its entirety and for all purposes.

BACKGROUND

Unless otherwise indicated herein, the materials described in this section are not prior art to the claims in this application and are not admitted to be prior art by inclusion in this section.

Computing devices such as personal computers, laptop computers, tablet computers, cellular phones, and countless types of Internet-capable devices are increasingly prevalent in numerous aspects of modern life. Over time, the manner in which these devices are providing information to users is becoming more intelligent, more efficient, more intuitive, and/or less obtrusive.

The trend toward miniaturization of computing hardware, peripherals, as well as of sensors, detectors, and image and audio processors, among other technologies, has helped open up a field sometimes referred to as "wearable computing." In the area of image and visual processing and production, in particular, it has become possible to consider wearable displays that place a graphic display close enough to a wearer's (or user's) eye(s) such that the displayed image appears as a normal-sized image, such as might be displayed on a traditional image display device. The relevant technology may be referred to as "near-eye displays."

Wearable computing devices with near-eye displays may also be referred to as "head-mountable displays" (HMDs), "head-mounted displays," "head-mounted devices," or "head-mountable devices." A head-mountable display places a graphic display or displays close to one or both eyes of a wearer. To generate the images on a display, a computer processing system may be used. Such displays may occupy a wearer's entire field of view, or only occupy part of wearer's field of view. Further, head-mounted displays may vary in size, taking a smaller form such as a glasses-style display or a larger form such as a helmet, for example.

Emerging and anticipated uses of wearable displays include applications in which users interact in real time with an augmented or virtual reality. Such applications can be mission-critical or safety-critical, such as in a public safety or aviation setting. The applications can also be recreational, such as interactive gaming. Many other applications are also possible.

SUMMARY

Example embodiments may provide an antenna assembly for use within a computing device, such as a head-mountable device (HMD), which has a limited internal volume for an antenna. In particular, the computing device may include a housing for a battery that provides power to the computing device. The housing may have no internal volume allocated for an antenna. However, the shape of the battery and the internal shape of the housing may be dissimilar such that space exists between the battery and the housing when the battery is arranged within the housing. Accordingly, example embodiments may take advantage of the air space in such a battery housing by arranging at least a portion of the antenna around the battery, in the space between the battery and the battery housing, such that the antenna and the battery do not contact one another.

In one aspect, a device may include: (a) an antenna that includes at least one conductor, (b) a housing that includes an inner-upper surface and an inner-lower surface separated by a first distance, (c) a battery disposed within the housing, where a base surface of the battery is proximate to the inner-lower surface of the housing, where a first portion of the battery has a height, extending up from the lower surface towards the inner-upper surface, which is substantially equal to the first distance, and wherein a second portion of the battery is of lesser height than the first portion of the battery such that space exists between the second portion of the battery and the inner-upper surface of the housing, and (d) where the at least one conductor is arranged over the second portion of the battery in the space between the inner-upper surface of the housing and the second portion of the battery, such that the at least one conductor and the battery do not contact one another, and where, as arranged, the antenna is capable of a far-field communication.

In another aspect, a device may include: (a) an antenna that includes at least one conductor, (b) a housing that includes an inner-upper surface and an inner-lower surface separated by a first distance, (c) a conductive object disposed within the housing, where a base surface of the conductive object is proximate to the inner-lower surface of the housing, where a first portion of the conductive object has a height, extending up from the lower surface towards the inner-upper surface, which is substantially equal to the first distance, and wherein a second portion of the conductive object is of lesser height than the first portion of the conductive object such that space exists between the second portion of the conductive object and the inner-upper surface of the housing, and (d) where the at least one conductor is arranged over the second portion of the conductive object in the space between the inner-upper surface of the housing and the second portion of the conductive object, such that the at least one conductor and the conductive object do not contact one another, and where, as arranged, the antenna is capable of a far-field communication.

These as well as other aspects, advantages, and alternatives will become apparent to those of ordinary skill in the art by reading the following detailed description, with reference where appropriate to the accompanying drawings.

DETAILED DESCRIPTION

Figure 1A:
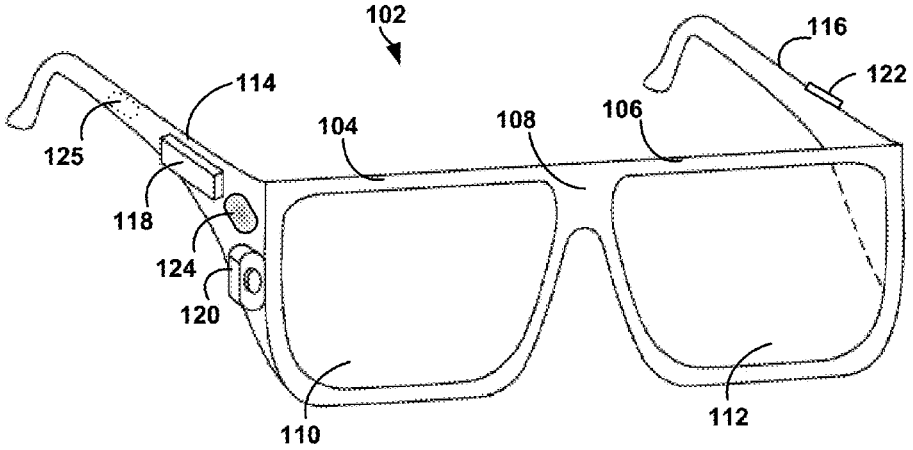
FIG. 1A illustrates a wearable computing system according to an example embodiment.

Example devices and systems are described herein. It should be understood that the words "example" and "exemplary" are used herein to mean "serving as an example, instance, or illustration." Any embodiment or feature described herein as being an "example" or "exemplary" is not necessarily to be construed as preferred or advantageous over other embodiments or features. In the following detailed description, reference is made to the accompanying figures, which form a part thereof. In the figures, similar symbols typically identify similar components, unless context dictates otherwise. Other embodiments may be utilized, and other changes may be made, without departing from the spirit or scope of the subject matter presented herein.

The example embodiments described herein are not meant to be limiting. It will be readily understood that the aspects of the present disclosure, as generally described herein, and illustrated in the figures, can be arranged, substituted, combined, separated, and designed in a wide variety of different configurations, all of which are contemplated herein.

I. Overview

Antennas are utilized by a variety of computing devices, including HMDs and mobile phones. Typically, a computing device may include an internal volume dedicated for an antenna. However, as devices become smaller and as device design focuses more on aesthetics, placement of an antenna on or within a device becomes more challenging. This challenge is further exacerbated by the inclusion of multiple antennas, each of which may be designed for a particular application and each requiring their own volume allocation. In some applications, it may be advantageous to arrange an antenna in any free space between a battery and a housing of the computing device that stores the battery.

Example embodiments may provide for an antenna assembly that may be arranged within a housing that is arranged on or a part of a HMD. The housing may include an internal volume that is designed to receive a battery that provides power to electrical components of the HMD. As such, the housing may not include an internal volume allocated for an antenna. The internal space of the housing may be different from the space occupied by the battery such that a gap may exist between at least a portion of the battery and the housing. A portion of the antenna may be arranged over and/or around a portion of the battery in the gap between the battery and the housing, such that the portion of the antenna and the battery do not contact one another. The portion of the antenna and the battery may be in such proximity to one another that they may be capacitively coupled.

As arranged, the antenna may be capable to receive and/or transmit radio waves signals to a second antenna located in the far-field region. The antenna may be configured to receive and/or transmit signals to perform, for example, GPS communications, Wi-Fi communications, Bluetooth communications, or cellular communications, among other communication types. The antenna may be about three-quarters of a wavelength to about a full wavelength in total length. The portion of the antenna arranged about the battery may be about a half wavelength in length. The wavelength may depend on the particular application of the antenna. Example wavelengths may include about 5.2 centimeters (cm) to about 5.8 cm, about 12 cm, about 12.5 cm, or about 19 cm.

The disclosed antenna assembly may be advantageous over conventional antenna designs. The disclosed antenna assembly may provide the computing device with an antenna with an overall length that is longer than typical antennas, which may cause the antenna to have a higher directivity. Further, as arranged, the antenna may have a larger effective receiving area than a standard antenna arranged differently. Additionally, because the antenna assembly utilizes the space between the housing and the battery, the antenna may receive or radiate signals more efficiently than an antenna directly contacting the battery. Other advantages are also possible.

It should be understood that the above embodiments and others described herein are provided for purposes of illustration, and are not intended to be limiting. Variations on the above embodiments and other embodiments are possible, without departing from the scope of the invention as set forth by the claims.

II. Example Wearable Computing Devices

Systems and devices in which example embodiments may be implemented will now be described in greater detail. In general, an example system may be implemented in or may take the form of a wearable computer (also referred to as a wearable computing device). In an example embodiment, a wearable computer takes the form of or includes a head-mountable device (HMD).

An example system may also be implemented in or take the form of other devices, such as a mobile phone, among other possibilities. Further, an example system may take the form of non-transitory computer readable medium, which has program instructions stored thereon that are executable by a processor to provide the functionality described herein. An example system may also take the form of a device such as a wearable computer or mobile phone, or a subsystem of such a device, which includes such a non-transitory computer readable medium having such program instructions stored thereon.

An HMD may generally be any display device that is capable of being worn on the head and places a display in front of one or both eyes of the wearer. An HMD may take various forms such as a helmet or eyeglasses. As such, references to "eyeglasses" or a "glasses-style" HMD should be understood to refer to an HMD that has a glasses-like frame so that it can be worn on the head. Further, example embodiments may be implemented by or in association with an HMD with a single display or with two displays, which may be referred to as a "monocular" HMD or a "binocular" HMD, respectively.

FIG. 1A illustrates a wearable computing system according to an example embodiment. In FIG. 1A, the wearable computing system takes the form of a head-mountable device (HMD) 102 (which may also be referred to as a head-mounted display). It should be understood, however, that example systems and devices may take the form of or be implemented within or in association with other types of devices, without departing from the scope of the invention. As illustrated in FIG. 1A, the HMD 102 includes frame elements including lens-frames 104, 106 and a center frame support 108, lens elements 110, 112, and extending side-arms 114, 116. The center frame support 108 and the extending side-arms 114, 116 are configured to secure the HMD 102 to a user's face via a user's nose and ears, respectively.

Each of the frame elements 104, 106, and 108 and the extending side-arms 114, 116 may be formed of a solid structure of plastic and/or metal, or may be formed of a hollow structure of similar material so as to allow wiring and component interconnects to be internally routed through the HMD 102. Other materials may be possible as well.

One or more of each of the lens elements 110, 112 may be formed of any material that can suitably display a projected image or graphic. Each of the lens elements 110, 112 may also be sufficiently transparent to allow a user to see through the lens element. Combining these two features of the lens elements may facilitate an augmented reality or heads-up display where the projected image or graphic is superimposed over a real-world view as perceived by the user through the lens elements.

The extending side-arms 114, 116 may each be projections that extend away from the lens-frames 104, 106, respectively, and may be positioned behind a user's ears to secure the HMD 102 to the user. The extending side-arms 114, 116 may further secure the HMD 102 to the user by extending around a rear portion of the user's head. Additionally or alternatively, for example, the HMD 102 may connect to or be affixed within a head-mounted helmet structure. Other configurations for an HMD are also possible.

The HMD 102 may also include an on-board computing system 118, an image capture device 120, a sensor 122, and a finger-operable touch pad 124. The on-board computing system 118 is shown to be positioned on the extending side-arm 114 of the HMD 102; however, the on-board computing system 118 may be provided on other parts of the HMD 102 or may be positioned remote from the HMD 102 (e.g., the on-board computing system 118 could be wire- or wirelessly-connected to the HMD 102). The on-board computing system 118 may include a processor and memory, for example. The on-board computing system 118 may be configured to receive and analyze data from the image capture device 120 and the finger-operable touch pad 124 (and possibly from other sensory devices, user interfaces, or both) and generate images for output by the lens elements 110 and 112.

The image capture device 120 may be, for example, a camera that is configured to capture still images and/or to capture video. In the illustrated configuration, image capture device 120 is positioned on the extending side-arm 114 of the HMD 102; however, the image capture device 120 may be provided on other parts of the HMD 102. The image capture device 120 may be configured to capture images at various resolutions or at different frame rates. Many image capture devices with a small form-factor, such as the cameras used in mobile phones or webcams, for example, may be incorporated into an example of the HMD 102.

Further, although FIG. 1A illustrates one image capture device 120, more image capture device may be used, and each may be configured to capture the same view, or to capture different views. For example, the image capture device 120 may be forward facing to capture at least a portion of the real-world view perceived by the user. This forward facing image captured by the image capture device 120 may then be used to generate an augmented reality where computer generated images appear to interact with or overlay the real-world view perceived by the user.

The sensor 122 is shown on the extending side-arm 116 of the HMD 102; however, the sensor 122 may be positioned on other parts of the HMD 102. For illustrative purposes, only one sensor 122 is shown. However, in an example embodiment, the HMD 102 may include multiple sensors. For example, an HMD 102 may include sensors 102 such as one or more gyroscopes, one or more accelerometers, one or more magnetometers, one or more light sensors, one or more infrared sensors, and/or one or more microphones. Other sensing devices may be included in addition or in the alternative to the sensors that are specifically identified herein.

The finger-operable touch pad 124 is shown on the extending side-arm 114 of the HMD 102. However, the finger-operable touch pad 124 may be positioned on other parts of the HMD 102. Also, more than one finger-operable touch pad may be present on the HMD 102. The finger-operable touch pad 124 may be used by a user to input commands. The finger-operable touch pad 124 may sense at least one of a pressure, position and/or a movement of one or more fingers via capacitive sensing, resistance sensing, or a surface acoustic wave process, among other possibilities. The finger-operable touch pad 124 may be capable of sensing movement of one or more fingers simultaneously, in addition to sensing movement in a direction parallel or planar to the pad surface, in a direction normal to the pad surface, or both, and may also be capable of sensing a level of pressure applied to the touch pad surface. In some embodiments, the finger-operable touch pad 124 may be formed of one or more translucent or transparent insulating layers and one or more translucent or transparent conducting layers. Edges of the finger-operable touch pad 124 may be formed to have a raised, indented, or roughened surface, so as to provide tactile feedback to a user when the user's finger reaches the edge, or other area, of the finger-operable touch pad 124. If more than one finger-operable touch pad is present, each finger-operable touch pad may be operated independently, and may provide a different function.

In a further aspect, HMD 102 may be configured to receive user input in various ways, in addition or in the alternative to user input received via finger-operable touch pad 124. For example, on-board computing system 118 may implement a speech-to-text process and utilize a syntax that maps certain spoken commands to certain actions. In addition, HMD 102 may include one or more microphones via which a wearer's speech may be captured. Configured as such, HMD 102 may be operable to detect spoken commands and carry out various computing functions that correspond to the spoken commands.

As another example, HMD 102 may interpret certain head-movements as user input. For example, when HMD 102 is worn, HMD 102 may use one or more gyroscopes and/or one or more accelerometers to detect head movement. The HMD 102 may then interpret certain head-movements as being user input, such as nodding, or looking up, down, left, or right. An HMD 102 could also pan or scroll through graphics in a display according to movement. Other types of actions may also be mapped to head movement.

As yet another example, HMD 102 may interpret certain gestures (e.g., by a wearer's hand or hands) as user input. For example, HMD 102 may capture hand movements by analyzing image data from image capture device 120, and initiate actions that are defined as corresponding to certain hand movements.

As a further example, HMD 102 may interpret eye movement as user input. In particular, HMD 102 may include one or more inward-facing image capture devices and/or one or more other inward-facing sensors (not shown) that may be used to sense a user's eye movements and/or positioning. As such, certain eye movements may be mapped to certain actions. For example, certain actions may be defined as corresponding to movement of the eye in a certain direction, a blink, and/or a wink, among other possibilities.

HMD 102 also includes a speaker 125 for generating audio output. In one example, the speaker could be in the form of a bone conduction speaker, also referred to as a bone conduction transducer (BCT). Speaker 125 may be, for example, a vibration transducer or an electroacoustic transducer that produces sound in response to an electrical audio signal input. The frame of HMD 102 may be designed such that when a user wears HMD 102, the speaker 125 contacts the wearer. Alternatively, speaker 125 may be embedded within the frame of HMD 102 and positioned such that, when the HMD 102 is worn, speaker 125 vibrates a portion of the frame that contacts the wearer. In either case, HMD 102 may be configured to send an audio signal to speaker 125, so that vibration of the speaker may be directly or indirectly transferred to the bone structure of the wearer. When the vibrations travel through the bone structure to the bones in the middle ear of the wearer, the wearer can interpret the vibrations provided by BCT 125 as sounds.

Various types of bone-conduction transducers (BCTs) may be implemented, depending upon the particular implementation. Generally, any component that is arranged to vibrate the HMD 102 may be incorporated as a vibration transducer. Yet further it should be understood that an HMD 102 may include a single speaker 125 or multiple speakers. In addition, the location(s) of speaker(s) on the HMD may vary, depending upon the implementation. For example, a speaker may be located proximate to a wearer's temple (as shown), behind the wearer's ear, proximate to the wearer's nose, and/or at any other location where the speaker 125 can vibrate the wearer's bone structure.

Figure 1B:
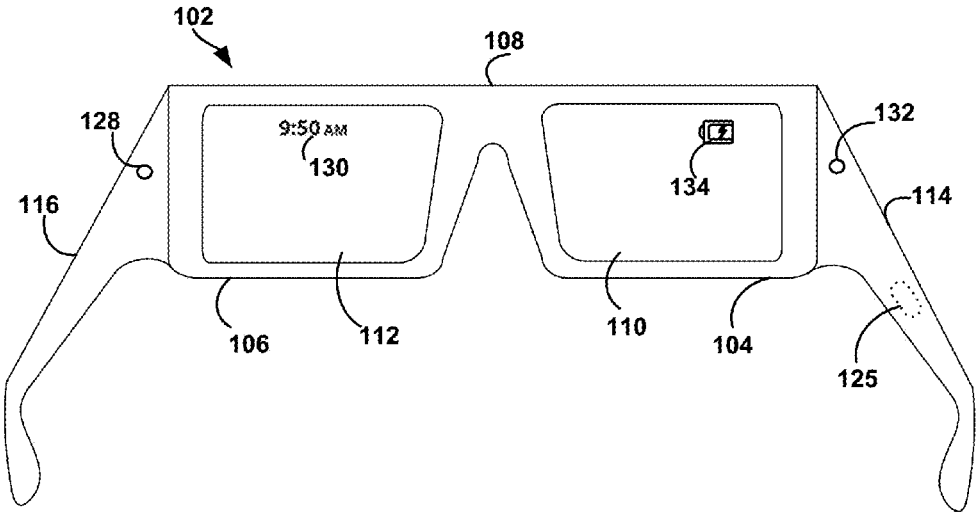
FIG. 1B illustrates an alternate view of the wearable computing device illustrated in FIG. 1A.

FIG. 1B illustrates an alternate view of the wearable computing device illustrated in FIG. 1A. As shown in FIG. 1B, the lens elements 110, 112 may act as display elements. The HMD 102 may include a first projector 128 coupled to an inside surface of the extending side-arm 116 and configured to project a display 130 onto an inside surface of the lens element 112. Additionally or alternatively, a second projector 132 may be coupled to an inside surface of the extending side-arm 114 and configured to project a display 134 onto an inside surface of the lens element 110.

The lens elements 110, 112 may act as a combiner in a light projection system and may include a coating that reflects the light projected onto them from the projectors 128, 132. In some embodiments, a reflective coating may not be used (e.g., when the projectors 128, 132 are scanning laser devices).

In alternative embodiments, other types of display elements may also be used. For example, the lens elements 110, 112 themselves may include: a transparent or semi-transparent matrix display, such as an electroluminescent display or a liquid crystal display, one or more waveguides for delivering an image to the user's eyes, or other optical elements capable of delivering an in focus near-to-eye image to the user. A corresponding display driver may be disposed within the frame elements 104, 106 for driving such a matrix display. Alternatively or additionally, a laser or LED source and scanning system could be used to draw a raster display directly onto the retina of one or more of the user's eyes. Other possibilities exist as well.

Figure 1C:
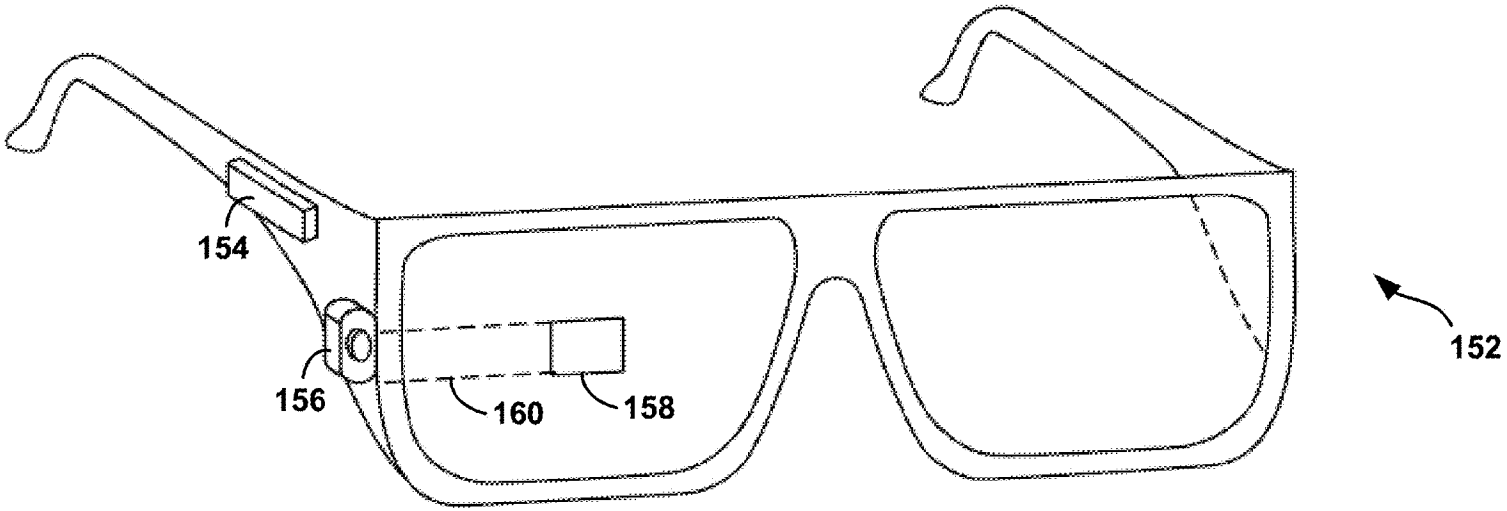
FIG. 1C illustrates another wearable computing system according to an example embodiment.

FIG. 1C illustrates another wearable computing system according to an example embodiment, which takes the form of an HMD 152. The HMD 152 may include frame elements and side-arms such as those described with respect to FIGS. 1A and 1B. The HMD 152 may additionally include an on-board computing system 154 and an image capture device 156, such as those described with respect to FIGS. 1A and 1B. The image capture device 156 is shown mounted on a frame of the HMD 152. However, the image capture device 156 may be mounted at other positions as well.

As shown in FIG. 1C, the HMD 152 may include a single display 158 which may be coupled to the device. The display 158 may be formed on one of the lens elements of the HMD 152, such as a lens element described with respect to FIGS. 1A and 1B, and may be configured to overlay computer-generated graphics in the user's view of the physical world. The display 158 is shown to be provided in a center of a lens of the HMD 152, however, the display 158 may be provided in other positions, such as for example towards either the upper or lower portions of the wearer's field of view. The display 158 is controllable via the computing system 154 that is coupled to the display 158 via an optical waveguide 160.

Figure 1D:
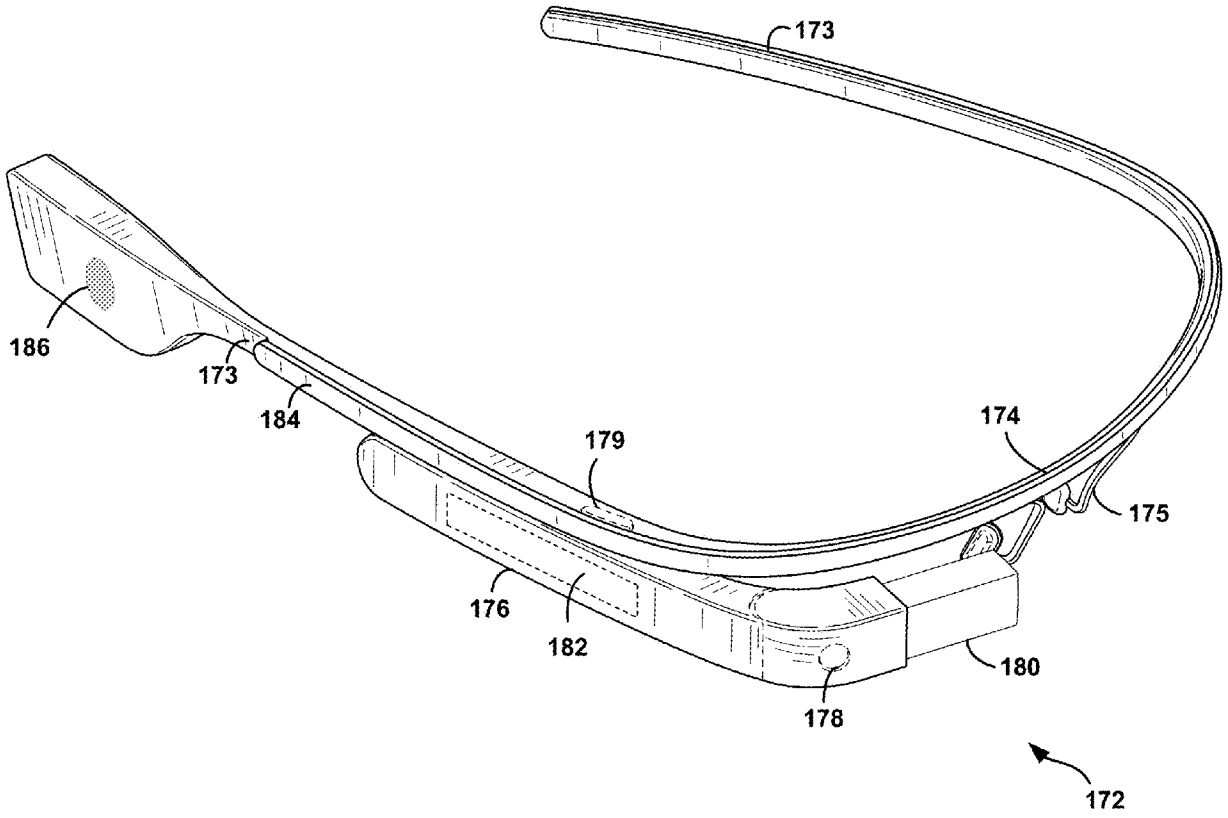
FIG. 1D illustrates another wearable computing system according to an example embodiment.

FIG. 1D illustrates another wearable computing system according to an example embodiment, which takes the form of a monocular HMD 172. The HMD 172 may include side-arms 173, a center frame support 174, and a bridge portion with nosepiece 175. In the example shown in FIG. 1D, the center frame support 174 connects the side-arms 173. The HMD 172 does not include lens-frames containing lens elements. The HMD 172 may additionally include a component housing 176, which may include an on-board computing system (not shown), an image capture device 178, and a button 179 for operating the image capture device 178 (and/or usable for other purposes). Component housing 176 may also include other electrical components and/or may be electrically connected to electrical components at other locations within or on the HMD. HMD 172 also includes a BCT 186.

The HMD 172 may include a single display 180, which may be coupled to one of the side-arms 173 via the component housing 176. In an example embodiment, the display 180 may be a see-through display, which is made of glass and/or another transparent or translucent material, such that the wearer can see their environment through the display 180. Further, the component housing 176 may include the light sources (not shown) for the display 180 and/or optical elements (not shown) to direct light from the light sources to the display 180. As such, display 180 may include optical features that direct light that is generated by such light sources towards the wearer's eye, when HMD 172 is being worn.

In a further aspect, HMD 172 may include a sliding feature 184, which may be used to adjust the length of the side-arms 173. Thus, sliding feature 184 may be used to adjust the fit of HMD 172. Further, an HMD may include other features that allow a wearer to adjust the fit of the HMD, without departing from the scope of the invention.

Figure 1E:
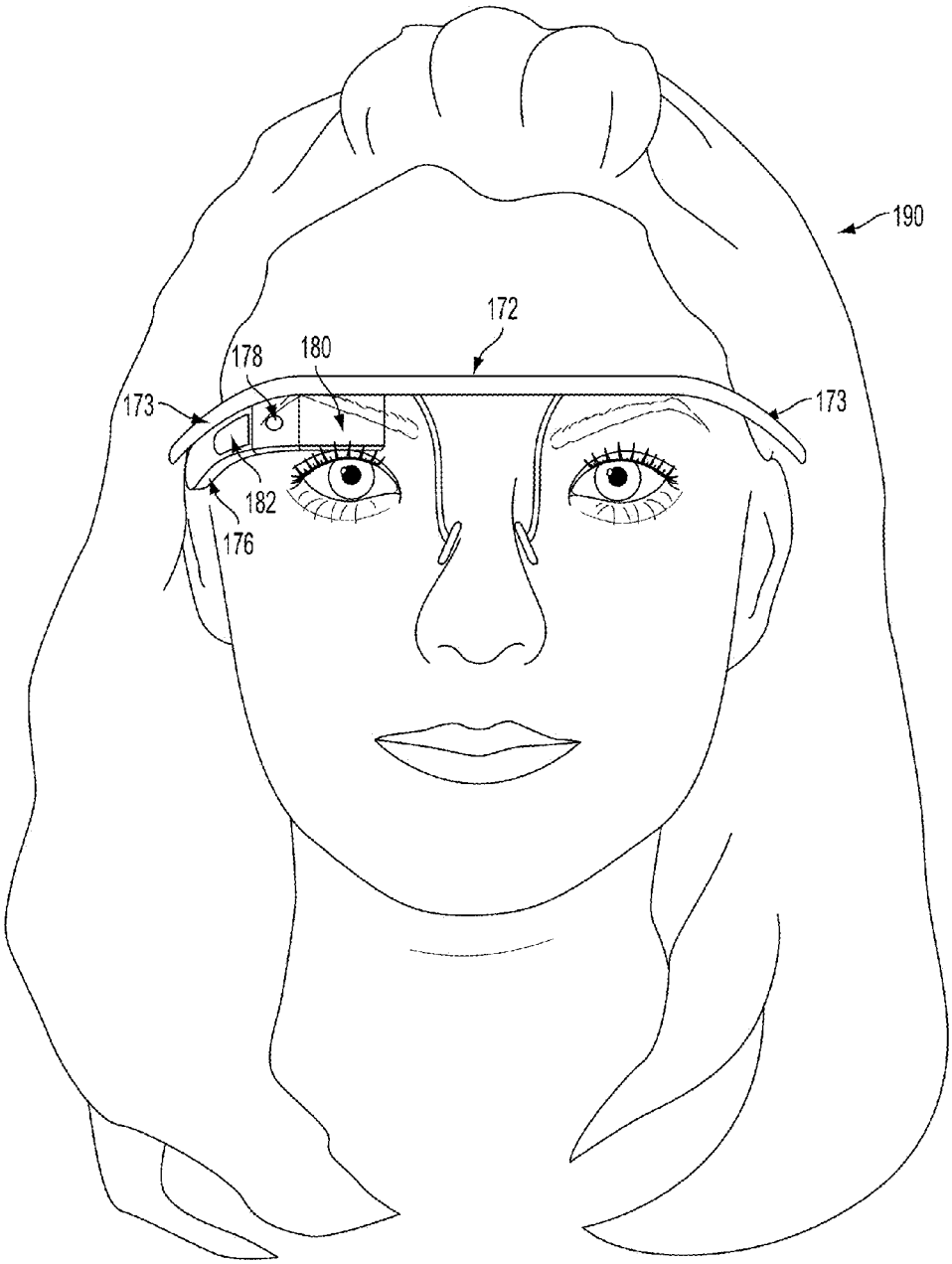
FIGS. 1E to 1G are simplified illustrations of the wearable computing system shown in FIG. 1D, being worn by a wearer.
Figure 1F:
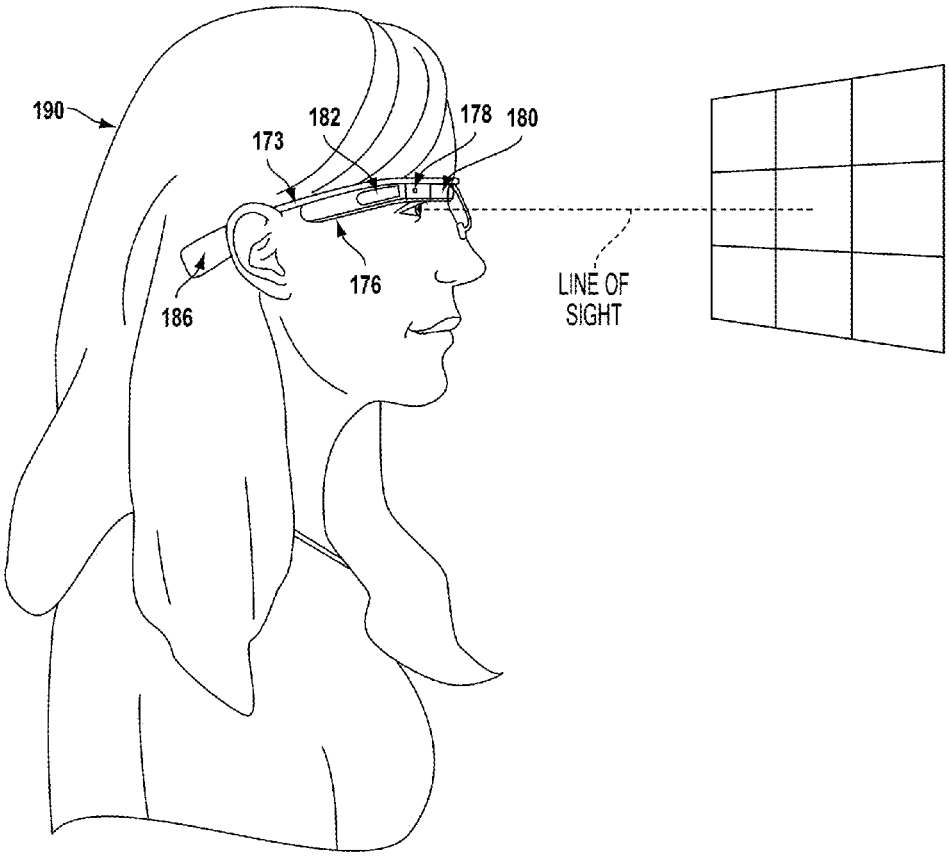
Figure 1G:
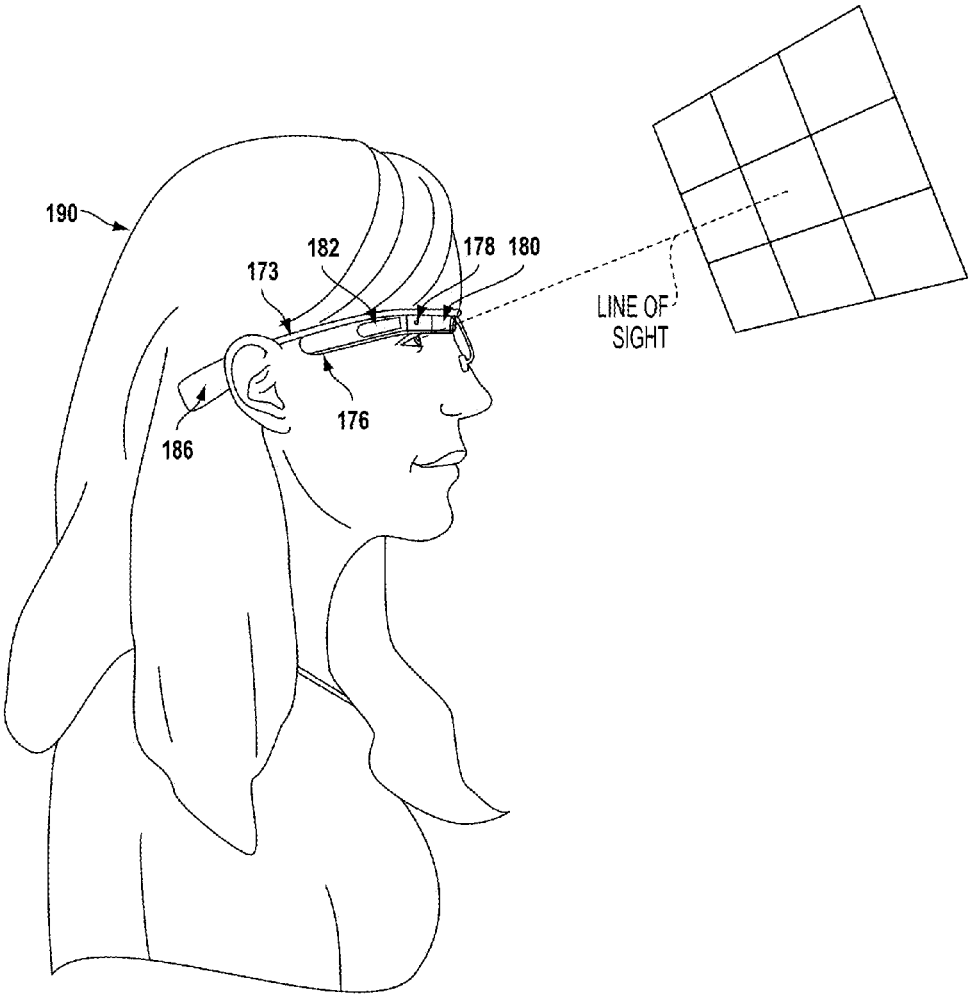

FIGS. 1E to 1G are simplified illustrations of the HMD 172 shown in FIG. 1D, being worn by a wearer 190. As shown in FIG. 1F, when HMD 172 is worn, BCT 186 is arranged such that when HMD 172 is worn, BCT 186 is located behind the wearer's ear. As such, BCT 186 is not visible from the perspective shown in FIG. 1E.

In the illustrated example, the display 180 may be arranged such that when HMD 172 is worn, display 180 is positioned in front of or proximate to a user's eye when the HMD 172 is worn by a user. For example, display 180 may be positioned below the center frame support and above the center of the wearer's eye, as shown in FIG. 1E. Further, in the illustrated configuration, display 180 may be offset from the center of the wearer's eye (e.g., so that the center of display 180 is positioned to the right and above of the center of the wearer's eye, from the wearer's perspective).

Configured as shown in FIGS. 1E to 1G, display 180 may be located in the periphery of the field of view of the wearer 190, when HMD 172 is worn. Thus, as shown by FIG. 1F, when the wearer 190 looks forward, the wearer 190 may see the display 180 with their peripheral vision. As a result, display 180 may be outside the central portion of the wearer's field of view when their eye is facing forward, as it commonly is for many day-to-day activities. Such positioning can facilitate unobstructed eye-to-eye conversations with others, as well as generally providing unobstructed viewing and perception of the world within the central portion of the wearer's field of view. Further, when the display 180 is located as shown, the wearer 190 may view the display 180 by, e.g., looking up with their eyes only (possibly without moving their head). This is illustrated as shown in FIG. 1G, where the wearer has moved their eyes to look up and align their line of sight with display 180. A wearer might also use the display by tilting their head down and aligning their eye with the display 180.

Figure 2:
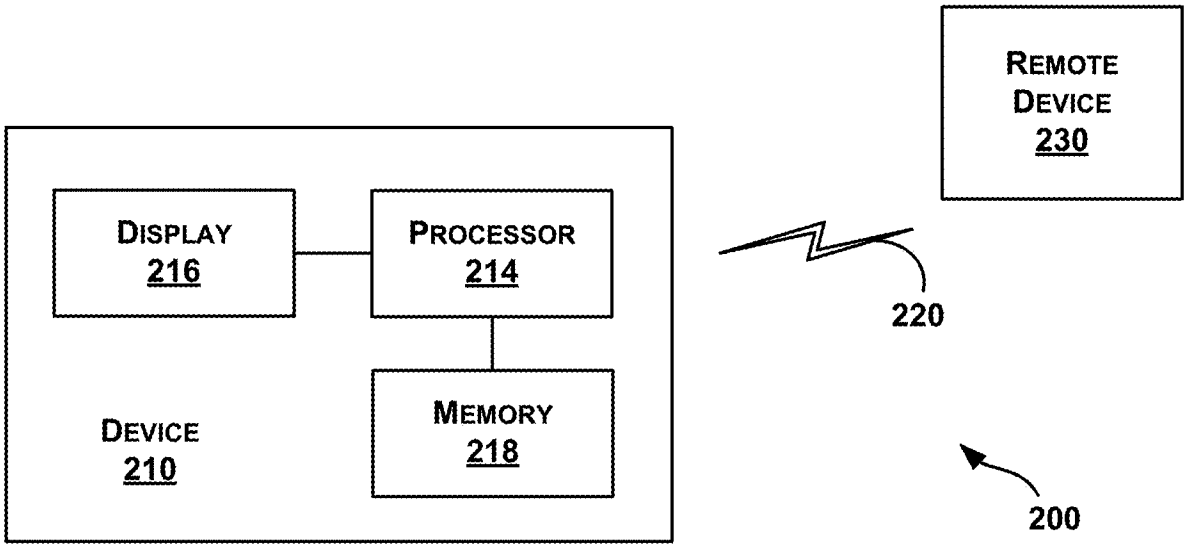
FIG. 2 is a simplified block diagram of a computing device according to an example embodiment.

FIG. 2 is a simplified block diagram of a computing device 210 according to an example embodiment. In an example embodiment, device 210 communicates using a communication link 220 (e.g., a wired or wireless connection) to a remote device 230. The device 210 may be any type of device that can receive data and display information corresponding to or associated with the data. For example, the device 210 may be a heads-up display system, such as the head-mounted devices 102, 152, or 172 described with reference to FIGS. 1A to 1G.

Thus, the device 210 may include a display system 212 comprising a processor 214 and a display 216. The display 210 may be, for example, an optical see-through display, an optical see-around display, or a video see-through display. The processor 214 may receive data from the remote device 230, and configure the data for display on the display 216. The processor 214 may be any type of processor, such as a micro-processor or a digital signal processor, for example.

The device 210 may further include on-board data storage, such as memory 218 coupled to the processor 214. The memory 218 may store software that can be accessed and executed by the processor 214, for example.

The remote device 230 may be any type of computing device or transmitter including a laptop computer, a mobile telephone, or tablet computing device, etc., that is configured to transmit data to the device 210. The remote device 230 and the device 210 may contain hardware to enable the communication link 220, such as processors, transmitters, receivers, antennas, etc.

Further, remote device 230 may take the form of or be implemented in a computing system that is in communication with and configured to perform functions on behalf of client device, such as computing device 210. Such a remote device 230 may receive data from another computing device 210 (e.g., an HMD 102, 152, or 172 or a mobile phone), perform certain processing functions on behalf of the device 210, and then send the resulting data back to device 210. This functionality may be referred to as "cloud" computing.

In FIG. 2, the communication link 220 is illustrated as a wireless connection; however, wired connections may also be used. For example, the communication link 220 may be a wired serial bus such as a universal serial bus or a parallel bus. A wired connection may be a proprietary connection as well. The communication link 220 may also be a wireless connection using, e.g., Bluetooth® radio technology, communication protocols described in IEEE 802.11 (including any IEEE 802.11 revisions), Cellular technology (such as GSM, CDMA, UMTS, EV-DO, WiMAX, or LTE), or Zigbee® technology, among other possibilities. The remote device 230 may be accessible via the Internet and may include a computing cluster associated with a particular web service (e.g., social-networking, photo sharing, address book, etc.).

Example Battery-Antenna Configurations

For purposes of context and explanation only, an example HMD that incorporates the disclosed antenna assembly is discussed. However, it should be understood that aspects of the disclosed antenna assembly may be utilized in other devices or systems and/or in other contexts, including a cellphone or other portable computing device that has limited internal volume for an antenna. Thus, the example HMD discussed below should be understood to be but one example of a system in which the disclosed antenna assembly may be utilized, and therefore should not be taken to be limiting.

An HMD, such as the head-mountable devices 102, 152, or 172, may include a housing that contains a battery that provides power to electrical components of the HMD. The housing may further contain all or a portion of an antenna. As such, the housing may be said to contain or otherwise be part of an antenna assembly.

Figure 3:
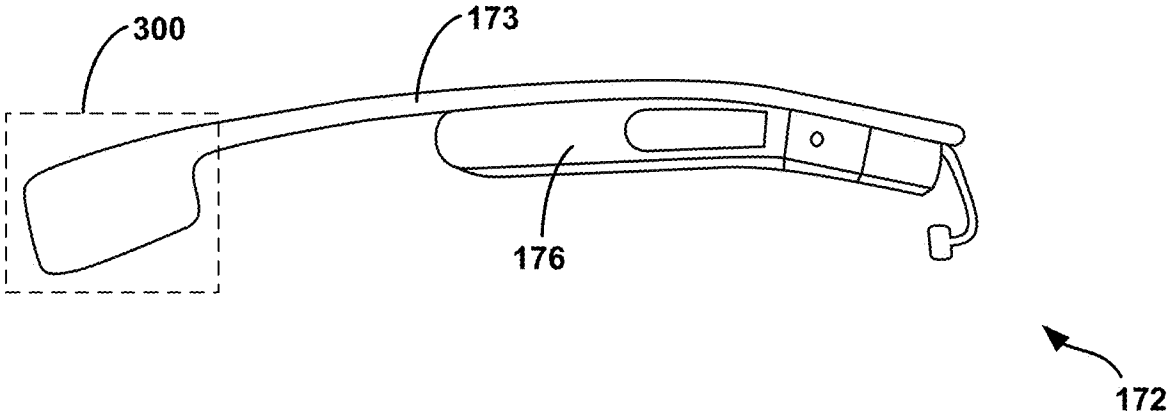
FIG. 3 illustrates a housing of a wearable computing system according to an example embodiment.

FIG. 3 depicts a housing 300 of the HMD 172 of FIG. 1D that may include an example antenna assembly. As shown, the housing 300 may be part of or otherwise connected to the side-arm 173. The internal structures of the housing 300, the side-arm 173, and the component housing 176 may be configured such that a connector (e.g., a wire) may electrically couple an element (e.g., an antenna) contained within the housing 300 to an element contained within the component housing 176 (e.g., a transceiver).

Figure 4:
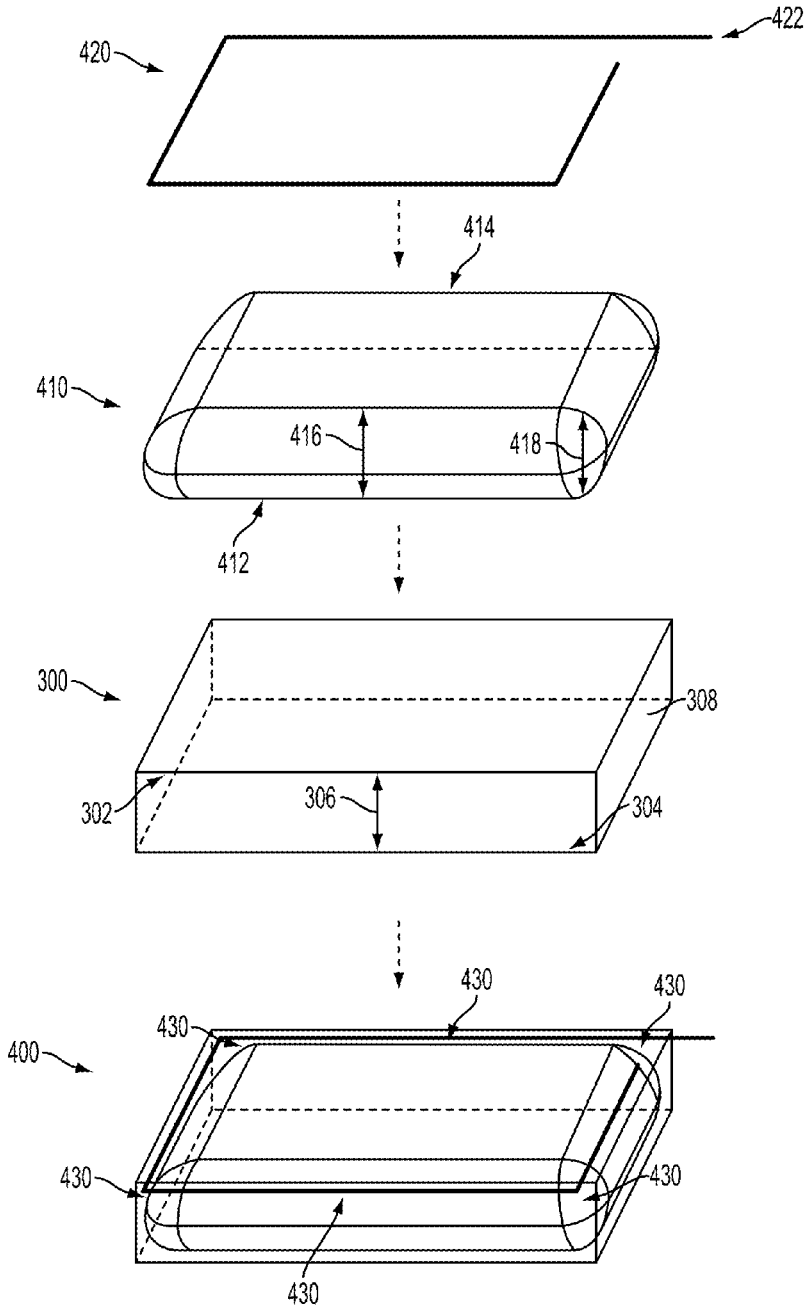
FIG. 4 illustrates an example antenna assembly according to an example embodiment.

FIG. 4 depicts an example antenna assembly 400, according to example embodiments. The antenna assembly 400 may include at least a portion of an antenna and a battery 410 that is disposed within the housing 300. The antenna may include at least one conductor 420 that is arranged substantially within the housing 300.

Broadly speaking, the housing 300 may take the form of an enclosed or partially enclosed structure. The housing 300 may include an inner-upper surface 302 and an inner-lower surface 304 separated by a first distance 306. The housing 300 may be physically coupled to the side-arm 173 at side 308. The housing 300 may be configured to receive the battery 410 and the at least portion of the antenna (e.g., the at least one conductor 420). In certain implementations, the housing 300 may include one or more removable surfaces. It should be understood that the housing 300 is illustrated as a rectangular structure for purposes of example and explanation only and should not be construed as limiting, other shapes and/or configurations are also possible. For example, one or more surfaces of the housing 300 may be curved.

Figure 5A:
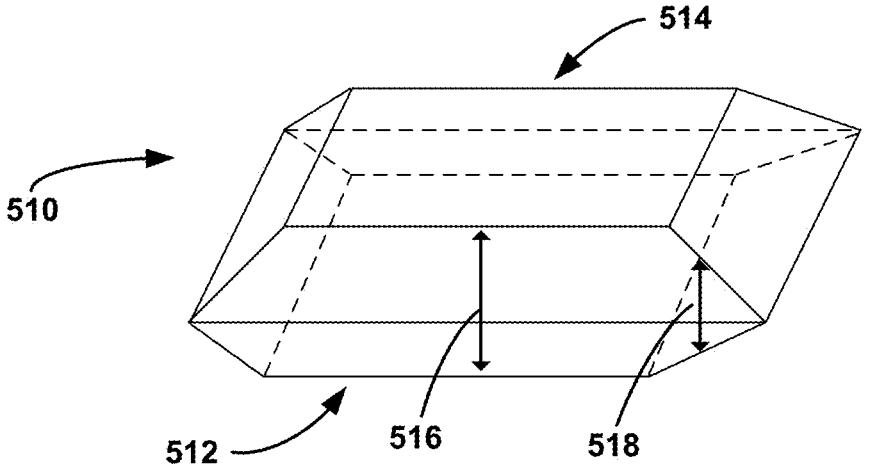
FIG. 5A illustrates an example battery according to an example embodiment.
Figure 5B:
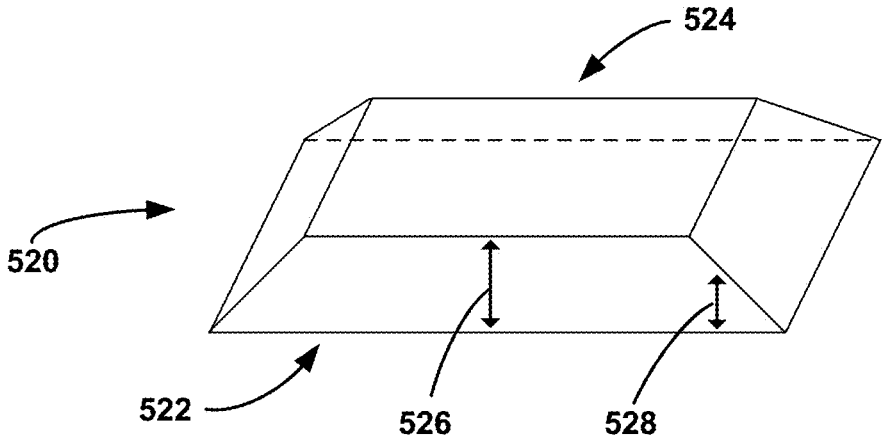
FIG. 5B illustrates another example battery according to an example embodiment.

The battery 410 may include a base surface 412, a top surface 414, a first portion of the battery that has a height 416 extending up from the base surface 412, and a second portion of the battery that has a lesser height 418 than the height 416 of the first portion of the battery. As shown, the second portion of the battery may include one or more rounded edges and/or one or more curved surfaces. The height 416 may be substantially equal to the first distance 306 of the housing 300. As shown, the lesser height 418 may be non-uniform. It should be understood that the battery 410 of FIG. 4 is but one example of a battery of the antenna assembly contemplated herein. FIGS. 5A and 5B depict other example batteries according to example embodiments.

FIG. 5A depicts a battery 510 that includes a base surface 512, a top surface 514, a first portion of the battery that has a height 516 extending up from the base surface 512, and a second portion of the battery that has a lesser height 518 than the height 516 of the first portion of the battery. As shown, the second portion of the battery may include one or more angled surfaces and may be non-uniform. The height 516 may be substantially equal to the first distance 306 of the housing 300.

FIG. 5B depicts a battery 520 that includes a base surface 522, a top surface 524, a first portion of the battery that has a height 526 extending up from the base surface 522, and a second portion of the battery that has a lesser height 528 than the height 526 of the first portion of the battery. As shown, the second portion of the battery may include one or more angled surfaces and may be non-uniform. The height 526 may be substantially equal to the first distance 306 of the housing 300. It should be understood that the disclosed antenna assembly might utilize other configurations of a battery with a shape dissimilar to the internal shape of a housing that stores the battery.

Returning to FIG. 4, the battery 410 may include a positive terminal and a negative terminal (not shown). The battery 410 may be a rechargeable battery (e.g., a lithium-ion battery, a lithium-ion polymer battery, a lead-acid battery, a nickel cadmium battery, or a nickel metal hydride battery, among other examples), or a disposable battery. As such, the battery 410 may be considered a conductive object. In certain embodiments, any other similarly shaped conductive object may replace the battery 410 without departing from the spirit of the present invention.

When the battery 410 is disposed within the housing 300, the base surface 412 may be proximate to the inner-lower surface 304 of the housing 300. In some implementations, because the height 416 of the battery 410 and the first distance 306 of the housing 300 may be substantially equal, the top surface 414 of the battery 410 may contact or nearly contact the inner-upper surface 302 of the housing 300. As such, a piece of material may be inserted between the inner-upper surface 302 and the top surface 414, such as, for example, a piece of foam or a substrate that includes a portion of the antenna (discussed further below).

In any event, because the second portion of the battery has the lesser height 418 than the first portion of the battery, space 430 may exist between the second portion of the battery and the inner-upper surface 302 of the housing 300. For example, the space 430 may be an air gap between the battery 410 and the housing 300. The at least one conductor 420 of the antenna may be arranged over the second portion of the battery 410 in the space 430 between the inner-upper surface 302 of the housing 300 and the second portion of the battery 410, such that the at least one conductor 420 and the battery 410 do not contact one another. As such, the at least one conductor 420 and the battery 410 may be capacitively coupled. In other implementations, for example, when the battery 510 of FIG. 5A is disposed within the housing 300, additional space may exist between the second portion of the battery and the inner-lower surface 304 of the housing 300. As such, alternatively or additionally, a portion of the antenna may be arranged in the additional space between the second portion of the battery and the inner-lower surface 304.

The at least one conductor 420 may be arranged over the battery 410 in a number of ways. In example implementations, the at least one conductor may be arranged in a shape substantially similar to a shape of a top surface of the battery. For example, as depicted in FIG. 4, the at least one conductor 420 may be arranged in a rectangular shape substantially similar to the shape of the top surface 414 of the battery 410. The at least one conductor may also be arranged such that the antenna is as far away from the battery as the housing permits. For example, the at least one conductor 420 may be arranged so as to be at located about the outer perimeter of the top surface 414 of the battery.

Further, the shape of the at least one conductor may include dimensions greater than dimensions of the top surface of the battery and less than dimensions of the bottom surface of the battery. For example, as depicted, the shape of the at least one conductor 420 includes a length and a width that are greater than the length and width of the top surface 414 and less than the length and width of the bottom surface 412. Other examples are certainly possible.

The physical length of the at least one conductor 420 may depend on the particular application of the antenna. In some implementations, the at least one conductor 420 may have a length of about a half wavelength. In other implementations, the at least one conductor 420 may have a length of about three-quarters of a wavelength. In yet other implementations, the at least one conductor 420 may have a length between about a half wavelength and three-quarters of a wavelength. The wavelength may be about 12 cm, 12.5 cm, or 19 cm. In some examples, the wavelength may be substantially within the range of 5.2 cm to 5.8 cm. In other implementations, the wavelength may be substantially within the range of about 5 cm to about 50 cm. It should be understood that these are but some possible examples of wavelengths and should not be construed as limiting. Other example wavelengths are certainly possible depending on the intended application of the antenna.

The at least one conductor 420 may include a feed end 422 that may directly or indirectly electrically couple the antenna to a component or a system (e.g., an on-board computing system) within the side-arm 173 and/or the component housing 176. For example, in some implementations, the feed end 422 may be electrically coupled to an antenna matching network located within the component housing 176. Additionally or alternatively, the feed end 422 may be electrically coupled to a transceiver located within the component housing 176. The transceiver may be configured for far-field communication and may receive power from the battery 410.

The antenna may further include a second conductor that is located outside of the housing 300 (e.g., within the side-arm 173 and/or within the component housing 176). In such embodiments, the antenna may have a total length between about three-quarters of a wavelength and a full wavelength. The second conductor may be electrically coupled to the battery. For example, the second conductor and the battery may be coupled via a common ground.

As arranged, the antenna may be capable of a far-field communication. Far-field communication may involve the antenna communicating (e.g., transmitting or receiving radio waves) with a second antenna that is located a distance of at least two wavelengths from the antenna. In some instances, the wavelength may be from about 5 cm to about 50 cm. Other wavelengths are also possible. Example far-field communications may include GPS communication, Wi-Fi communication, or Bluetooth communication, among other far-field communication types.

Arranging the at least one conductor 420 in the space 430 between the housing 300 and the battery 410 may be advantageous for a number of reasons. For example, the overall length of the antenna may be able to be longer than a typical quarter-wavelength or half-wavelength antenna, which may cause the antenna to exhibit a higher directivity (e.g., a less isotropic radiation pattern) than a quarter-wavelength or a half-wavelength antenna in the same battery-housing arrangement. In certain applications (e.g., in GPS communications), a higher directivity may be beneficial. The increased length may also provide for an increased effective receiving area.

Further, arranging the at least one conductor 420 in the space 430 over the battery 410 and along the outer perimeter of the top surface 414 of the battery 410 may allow the antenna to radiate and/or receive radio waves more efficiently than an antenna arranged differently. For example, an antenna traced on or otherwise directly contacting a battery or other conductive surface may receive or radiate signals poorly, if at all. This may occur because when electric current is flowing on a conductor (e.g., an antenna) over a ground plane (e.g., a battery or other conductive surface) the ground plane produces an image current flowing in the opposite direction. Consequently, if the conductor and the ground plane are located too close to one another, the image current may effectively cancel out any current flowing on the conductor. Thus, the disclosed antenna assembly may reduce such a canceling effect by increasing the space between the antenna and the battery. Other advantages are possible as well.

In example implementations, the antenna assembly 400 may further include a substrate that includes the at least one conductor 420. The substrate may provide structural support for the at least one conductor. For example, the at least one conductor may be traced or otherwise printed on the substrate. The substrate may be configured with dimensions (e.g., a length and width) such that the substrate may be arranged within the housing 300 and may include the at least one conductor 420. The substrate may be arranged between the inner-upper surface 302 of the housing 300 and the top surface 414 of the battery 410 such that the at least one conductor 420 and the battery 410 do not contact one another.

The substrate may be made of any suitable material. In certain embodiments, the substrate may be made of a flexible material. In particular, the substrate may be made of a flexible plastic material or a flexible polyester material. For example, the substrate may be a flexible printed circuit board. Other examples of substrate material are certainly possible.

Figure 6:
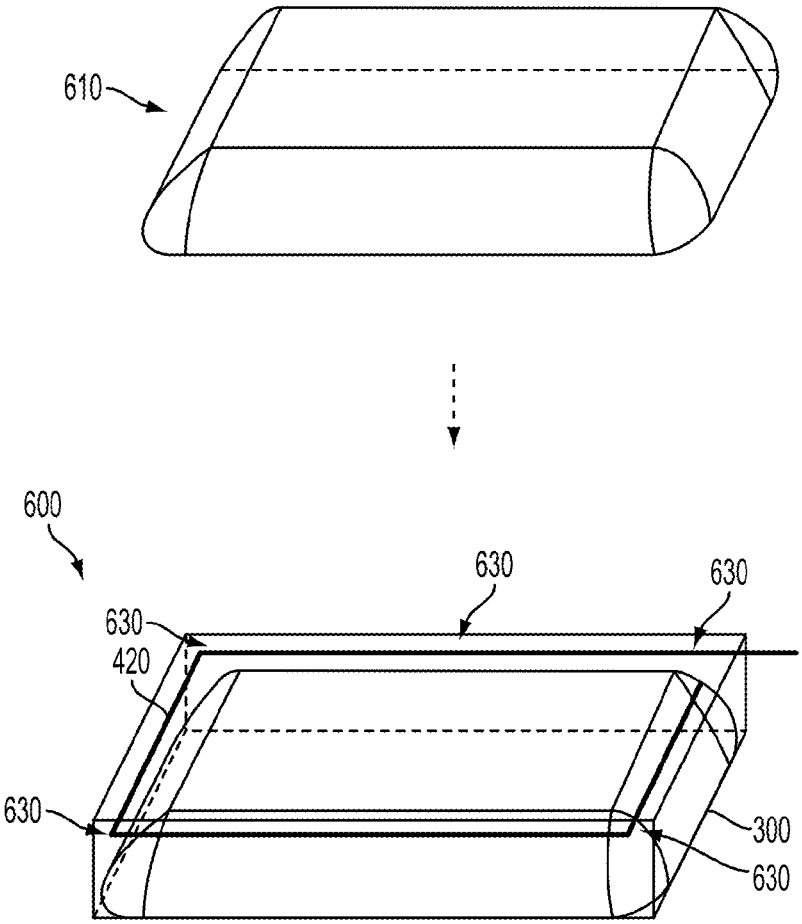
FIG. 6 illustrates an example antenna assembly according to an example embodiment.

FIG. 6 depicts an example antenna assembly 600, according to example embodiments. The antenna assembly 600 may include a battery 610 that is disposed within the housing 300 and the at least one conductor 420 that is arranged about the battery 610 in space 630 between the battery 610 and the housing 300. As shown, the battery 610 may include one or more rounded edges and/or one or more curved surfaces. It should be understood that this is but one possible alternative implementation of the disclosed antenna assembly and should not be construed as limiting.

IV. Conclusion

It should be understood that the examples described with reference to an HMD are not limited to an HMD. It is contemplated that the example methods and systems described with reference to an HMD may be implemented on other types of computing devices, such as other types of wearable devices, mobile phones, tablet computers, and/or laptop computers, for instance.

More generally, while various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A device comprising:

an antenna that comprises at least one conductor;

a housing that comprises an inner-upper surface and an inner-lower surface separated by a first distance;

a battery disposed within the housing, wherein a base surface of the battery is proximate to the inner-lower surface of the housing, wherein a first portion of the battery has a height, extending up from the lower surface towards the inner-upper surface, which is substantially equal to the first distance, and wherein a second portion of the battery is of lesser height than the first portion of the battery such that space exists between the second portion of the battery and the inner-upper surface of the housing; and wherein the at least one conductor is arranged over the second portion of the battery in the space between the inner-upper surface of the housing and the second portion of the battery, such that the at least one conductor and the battery do not contact one another, and wherein, as arranged, the antenna is capable of a far-field communication.

2. The device of claim 1, wherein the antenna is a first antenna, and wherein the far-field communication comprises the first antenna communicating with a second antenna that is located a distance of at least two wavelengths from the first antenna.

3. The device of claim 2, wherein the wavelength is substantially within the range of 5 centimeters (cm) to 50 cm.

4. The device of claim 1, wherein the far-field communication is a global position system communication.

5. The device of claim 1, wherein the at least one arm comprises a length of about a half of a wavelength.

6. The device of claim 5, wherein the wavelength is substantially within the range of 5 cm to 50 cm.

7. The device of claim 1, wherein the at least one arm comprises a shape substantially similar to a shape of a top surface of the battery.

8. The device of claim 7, wherein the shape of the at least one arm comprises dimensions greater than dimensions of the top surface and less than dimensions of the bottom surface.

9. The device of claim 1, wherein the antenna further comprises a second arm that is located outside of the housing.

10. The device of claim 1, wherein the second portion of the battery comprises one or more rounded edges.

11. The device of claim 1, further comprising a substrate that comprises the at least one arm, wherein the substrate is arranged between the inner-upper surface and a top surface of the battery.

12. The device of claim 11, wherein the substrate comprises a flexible material.

13. The device of claim 11, wherein the substrate comprises one of a flexible plastic material and a flexible polyester material.

14. The device of claim 1, wherein the antenna and the battery are electrically coupled.

15. The device of claim 1, wherein the at least one arm and the battery are capacitively coupled.

16. The device of claim 1, further comprising a transceiver electrically coupled to the antenna and the battery.

17. The device of claim 16, wherein the transceiver is configured for far-field communication.

18. A device comprising:

an antenna that comprises at least one arm;

a housing that comprises an inner-upper surface and an inner-lower surface separated by a first distance;

a conductive object disposed within the housing, wherein a base surface of the conductive object is proximate to the inner-lower surface of the housing, wherein a first portion of the conductive object has a height, extending up from the lower surface towards the inner-upper surface, which is substantially equal to the first distance, and wherein a second portion of the conductive object is of lesser height than the first portion of the conductive object such that space exists between the second portion of the conductive object and the inner-upper surface of the housing; and wherein the at least one conductor is arranged over the second portion of the conductive object in the space between the inner-upper surface of the housing and the second portion of the conductive object, such that the at least one conductor and the conductive object do not contact one another, and wherein, as arranged, the antenna is capable of a far-field communication.

19. The device of claim 18, wherein the at least one arm comprises a length of about a half of a wavelength.

20. The device of claim 19, wherein the wavelength is substantially within the range of 5 cm to 50 cm.

* * * * *